United States Patent [19]

Mueller et al.

[11] Patent Number: 4,971,462

[45] **Date of Patent: * Nov. 20, 1990**

[54] PLURAL CASSETTES HAVING COMPATIBILITY ARRANGEMENT

[75] Inventors: Hans W. Mueller, Cortland; Samuel D. Cappotto, Syracuse, both of N.Y.

[73] Assignee: Smith Corona Corporation, Cortland, N.Y.

[ * ] Notice: The portion of the term of this patent subsequent to Feb. 13, 2007 has been disclaimed.

[21] Appl. No.: 430,107

[22] Filed: Nov. 1, 1989

Related U.S. Application Data

[63] Continuation of Ser. No. 214,982, Jul. 5, 1988, abandoned, which is a continuation-in-part of Ser. No. 126,152, Nov. 30, 1987, Pat. No. 4,900,171.

[51] Int. Cl.[5] ..... B41J 35/28

[52] U.S. Cl. ..... 400/208; 400/697.1

[58] Field of Search ..... 400/194, 195, 196, 196.1, 400/206, 206.1, 206.2, 206.3, 206.4, 207, 208, 208.1, 214, 222, 240, 240.1, 240.3, 240.4, 695, 696, 697, 697.1

[56] References Cited

U.S. PATENT DOCUMENTS

| | | | |
|---|---|---|---|
| D. 289,529 | 4/1987 | Cappotto et al. | D18/22 |
| 3,731,781 | 5/1973 | Caudill et al. . | |
| 4,131,372 | 12/1978 | Hengelhaupt | 400/227 |
| 4,239,107 | 12/1980 | Boyatt, Jr. et al. | 206/225 |
| 4,247,210 | 1/1981 | Kacmarcik et al. . | |
| 4,302,118 | 11/1981 | Schaefer | 400/208 |
| 4,329,072 | 5/1982 | Kacmarcik | 400/208 |
| 4,347,007 | 8/1982 | Schaefer | 400/208 |
| 4,350,453 | 9/1982 | Field et al. . | |
| 4,353,657 | 10/1982 | Schaefer . | |
| 4,397,575 | 8/1983 | Aldrich | 400/208 |
| 4,407,593 | 10/1983 | Haftmann . | |
| 4,516,137 | 5/1985 | Yasui | 346/76 R |
| 4,606,662 | 8/1986 | Komplin | 400/697.1 X |
| 4,611,936 | 9/1986 | Yasui . | |
| 4,611,938 | 9/1986 | Rettke et al. . | |
| 4,616,945 | 10/1986 | Komplin | 400/697.1 |
| 4,630,097 | 1/1967 | Goubeaux | 400/196.1 |
| 4,694,305 | 9/1987 | Shiomi et al. | 400/206 X |
| 4,747,714 | 5/1988 | Moritz et al. | 400/697.1 X |

FOREIGN PATENT DOCUMENTS

| | | | |
|---|---|---|---|
| 2705127 | 2/1977 | Fed. Rep. of Germany | 400/196.1 |
| 3346482 | 7/1984 | Fed. Rep. of Germany . | |
| 56-144985 | 11/1981 | Japan . | |
| 0191184 | 11/1983 | Japan | 400/208 |
| 0070597 | 4/1984 | Japan | 400/208 |
| 59-78879 | 5/1984 | Japan . | |
| 59-93376 | 5/1984 | Japan . | |
| 59-222380 | 12/1984 | Japan . | |
| 61-31284 | 2/1986 | Japan . | |
| 0054975 | 3/1986 | Japan | 400/208 |
| 0066682 | 4/1986 | Japan | 400/208 |
| 61-14;6576 | 7/1986 | Japan . | |
| 0025079 | 2/1987 | Japan | 400/208 |
| 2179917 | 3/1987 | United Kingdom . | |

OTHER PUBLICATIONS

IBM Technical Disclosure Bulletin, "Printer Ribbon Cartridge Insertion Position Locators", vol. 29, No. 4, Sep., 1986, pp. 1571–1572.

IBM Technical Disclosure Bulletin, "Low Cost Cartridge Code Detector", vol. 25, No. 4, Sep., 1982, pp. 1980 and 1981.

(List continued on next page.)

*Primary Examiner*—Eugene H. Eickholt

[57] ABSTRACT

An arrangement for assuring ink ribbon and correction tape compatibility in a device which utilizes a first cassette having an ink ribbon therein and a second cassette having a correction tape therein in the operation thereof, the arrangement including engaging formations located on the first and second cassettes which ensure that the ink ribbon and correction tape are functionally compatible with each other when the respective cassettes are inserted in the device such as, for example, functional compatibility between a single-strike ink ribbon and a lift-off correction tape, or functional compatibility between a multiple-strike ink ribbon and a cover-up correction tape.

19 Claims, 3 Drawing Sheets

OTHER PUBLICATIONS

IBM Technical Disclosure Bulletin, "Two-Color Cartridge Ribbon System with Correction", Schaefer, vol. 22, No. 6, Nov., 1979, pp. 2327-2329.

IBM Technical Disclosure Bulletin, "Protective Carton", Dunning et al., vol. 25, No. 4, Sep., 1982, pp. 1944-1945.

IBM Technical Disclosure Bulletin, "Page Width Ribbon Cartridge and Drive Mechanism", Thorne, vol. 25, No. 4, Sep., 1982, pp. 2020-2022.

IBM Technical Disclosure Bulletin, "Web-Tension Sensing Devices", Buchholz et al., vol. 25, No. 4, Sep., 1982, pp. 2066-2067.

IBM Technical Disclosure Bulletin, "Constant Head Wrap Tape Drive", Wenner, vol. 25, No. 4, Sep., 1982, p. 2068.

IBM Technical Disclosure Bulletin, "Web-Guiding Stress Functions", Winarski, vol. 25, No. 4, Sep., 1982, p. 2069.

IBM Technical Disclosure Bulletin, "Stuffer Ribbon Cartridge", Purcell, vol. 25, No. 4, Sep., 1982, pp. 2153-2154.

IBM Technical Disclosure Bulletin, "End-Of-Ribbon Sensor and Cartridge-Present Indicator", Jenkins, vol. 27, No. 6, Nov., 1984, pp. 3645-3647.

PLURAL CASSETTES HAVING COMPATIBILITY ARRANGEMENT

This application is a continuation of application Ser. No. 07/214,982, filed July 7, 1988, now abandoned, which is a continuation-in-part of Ser. No. 07/126,152, filed Nov. 30, 1987, now U.S. Pat. No. 4,900,171, issued Feb. 13, 1990.

Statements as to Rights to Inventions Made Under Federally Sponsored Research and Development The invention disclosed and claimed herein was not made under any federally sponsored research and development program.

BACKGROUND OF THE INVENTION (1) Field of the Invention

This invention is directed to cassettes used with devices such as typewriters or text printers which utilize at least two different cassettes, such as a ribbon cassette and a correcting cassette.

(2) Description of the Prior Art

Various prior art devices disclose means by which the operability of a typewriter or printer is controlled by the condition or type of cassette present in the typewriter or printer. U.S. Pat. No. 4,636,097, for example, includes means for rendering the printer inoperable when the end of the typewriter ribbon in a cassette is sensed, or when there is no cassette in the printer. Another such device is disclosed in IBM Technical Disclosure Bulletin, "Low Cost Cartridge Code Detector," Craft, Volume 25, No. 4, September 1982, pp. 1980, 1981. The cassette disclosed therein provides a signal to the device (such as a typewriter) which identifies the contents of the cassette, so that the device may adjust to the characteristics of the cassette contents. Still another such device is disclosed in U.S. Pat. No. 4,516,137 wherein the presence or absence of a thermal ribbon cassette is sensed by the printer. If a thermal ribbon cassette is present, the printer can print only unidirectionally, whereas when the ribbon cassette is not present, the printer prints bi-directionally.

There are, in addition, prior art devices which disclose means for connecting a ribbon cassette to a correcting cassette. Examples of such prior art devices are U.S. Pat. No. 4,239,107 and U.S. Pat. No. 4,302,118. The 118 patent discloses mating formations adapted to place a ribbon cassette in register with a correcting cassette, and also discloses means on the cassette which control the selection of the correct feed and ribbon lift mechanism.

SUMMARY OF THE INVENTION

The present invention is directed to means for making certain that in devices such as typewriter or printers which may utilize at least two different cassettes, such as a ribbon cassette and a correcting cassette, the cassettes are functionally compatible with each other.

In common practice, a typewriter ribbon cassette includes a plastic jacketing in which the ribbon and various components are conveniently housed. These components may include, among other things, a supply spool upon which a supply of typewriter ribbon is located, mechanism for assuring the uniform withdrawal of ribbon from the supply spool to the typewriter print point, and a take-up spool on which the typed ribbon is located. A typewriter drive mechanism rotates the take-up spool to cause fresh ribbon from the supply spool to advance to the print point. A typewriter ribbon cassette of this type is disclosed in U.S Pat. No. 4,302,118.

Such typewriter ribbon cassettes may contain various types of ribbons. For example, the ribbon may be of the single-strike carbon ribbon type or of the multiple-strike carbon ribbon type. If the ribbon is a single-strike carbon ribbon, the ribbon is incrementally fed in such a manner that upon a single character being typed on a portion of the ribbon, the ribbon is advanced so that the next character is typed on a fresh portion of the ribbon.

If the ribbon is a multiple-strike ribbon, such as the "Multi-Strike" ribbon sold by Smith Corona Corporation, the ribbon is incrementally fed in such a manner that upon a character being typed on a ribbon, the ribbon is advanced a lesser distance so that the next character is typed on a ribbon portion comprising both a typed ribbon portion and a fresh ribbon portion. In this manner, significantly more characters may be typed on a multiple-strike ribbon than on a single-strike ribbon.

A typewriter correcting cassette may also include a plastic jacketing for conveniently housing a correcting tape and various components. As in the typewriter ribbon cassette, the components of a correcting cassette may include a supply spool, means for assuring the uniform withdrawal of correcting tape from the supply spool, and a take-up spool. Here too, the correcting tape may be of two types, namely, the type commonly referred to as "lift-off" tape, in which the tape, upon striking the unwanted character, removes the unwanted character from the paper, or the type commonly referred to as "cover-up" tape, in which, upon the tape striking the unwanted character, a powdered material on the tape is transferred to and covers up the unwanted character on the paper.

In the existing market, with few, if any, exceptions, lift-off correcting tape is primarily compatible with single-strike carbon ribbons, and cover-up correcting tape is primarily compatible with multiple-strike carbon ribbons. Each combination of cassettes having compatible ribbon and correcting tapes may be termed a cassette combination or assembly. Therefore, in a typewriter which permits the use of both single-strike and multiple-strike ribbons as well as both lift-off and cover-up correcting tapes, it is desirable to provide means to assure that the lift-off correcting tape is used only with compatible single-strike carbon ribbons and that the cover-up tape is used only with compatible multiple-strike ribbons. The present invention is directed to means for providing a simple, reliable means to assure that the lift-off tape cassette can be used only with the compatible single-strike ribbon cassette and that the cover-up tape cassette can be used only with the compatible multiple-strike ribbon cassette.

That is achieved, in general, by providing the cassette with means for assuring that the first cassette is functionally compatible with the corresponding second cassette of the combination or assembly upon the cassettes being inserted into a device, such as a typewriter or printer in a system which utilizes the cassettes.

According to the present invention, if it is attempted to utilize a cassette having the foregoing means with a second cassette which is not compatible with that cassette, i.e., of a different cassette combination, the means for assuring cassette compatibility will prevent the first cassette from being properly placed in the device and indicating to the operator that an attempt is being made to place into the device a cassette which is not compatible with another being so placed.

BRIEF DESCRIPTION OF THE DRAWINGS

A further understanding of the present invention may be had when the following detailed description is read in conjunction with the accompanying drawings, in which.

DETAILED DESCRIPTION OF THE PREFERRED EMBODIMENT

Figure 1:
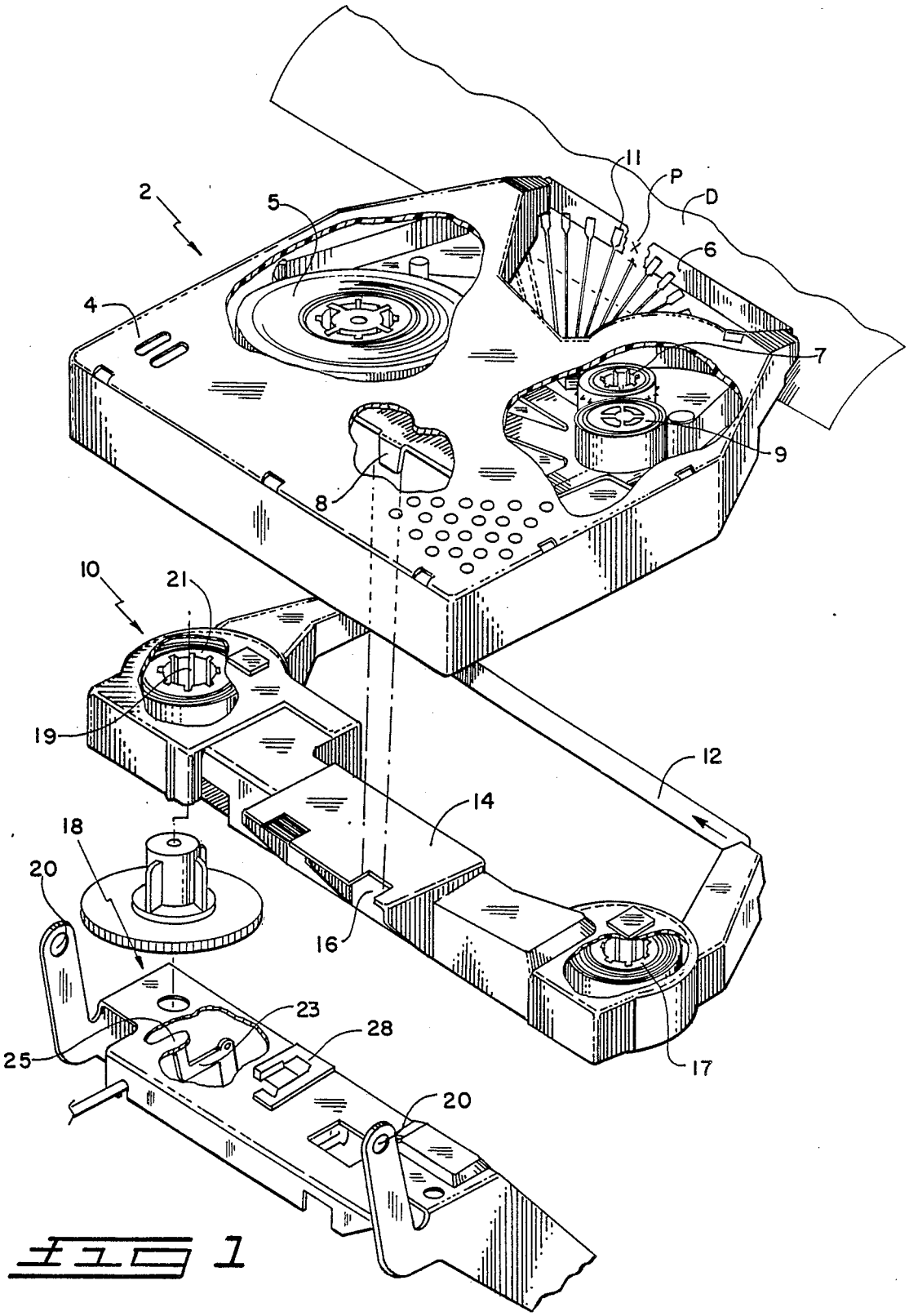
FIG. 1 is an exploded top perspective view of the present invention showing a cassette combination including a first typewriter ribbon cassette, a first correction tape cassette, and a partial view of a shiftable bracket section which carries the ribbon cassette and correction tape thereon.
Figure 3:
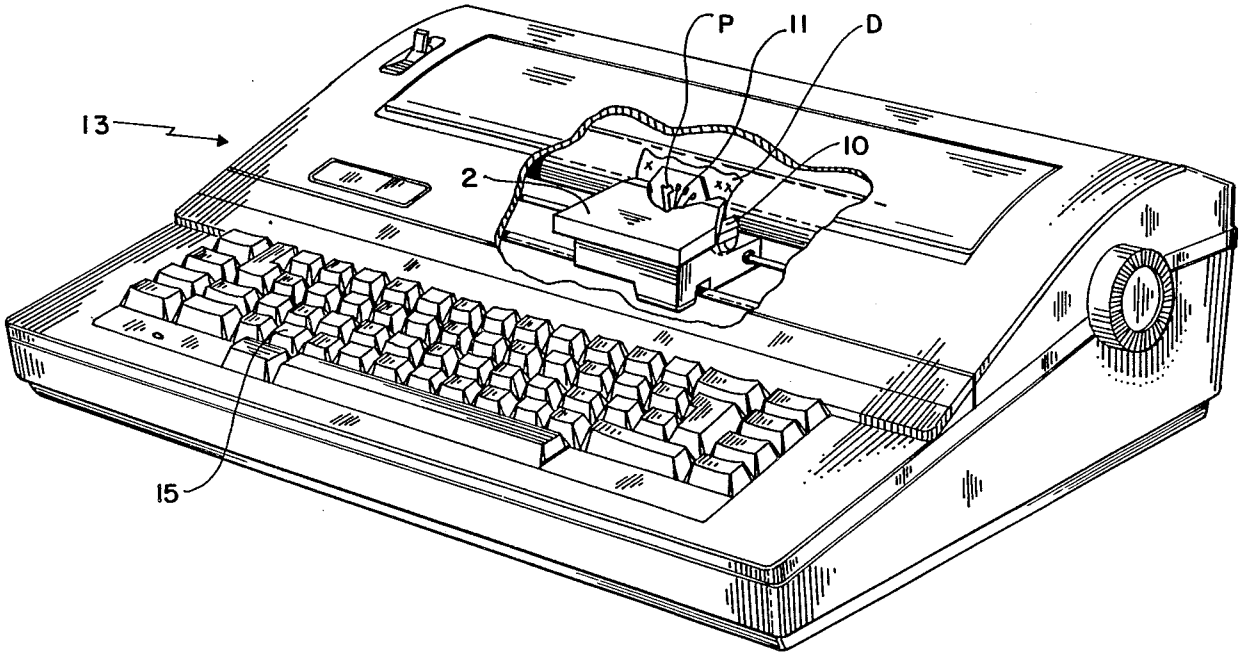
FIG. 3 is a top perspective view of a conventional typewriter within which the present invention may be used.

There is shown in FIG. 1 a first typewriter ribbon cassette 2 having a housing 4 within which a first typewriter ribbon 6 (which may be of the single-strike carbon ribbon type), and various other components, are housed. A formation 8, such as a tab, extends from the right-hand portion of the bottom of the housing 4 for a purpose to be described hereinafter. As noted above, a single-strike carbon ribbon is of the type which is incrementally fed in such a manner that upon a character being typed on a ribbon portion, the ribbon is advanced so that the next character is typed on a fresh portion of the ribbon. These components, may include, among other things, a supply roll 5 upon which a typewriter ribbon supply is located, a mechanism 7 for assuring the uniform withdrawal of ribbon 6 from the supply roll 5 to the typewriter print point P (best seen in FIG. 3), and a take-up spool 9 on which the typed ribbon is located. Such a cassette is presently being sold by Smith Corona Corporation under its "H Correctable" mark.

Also in FIG. 1, there is disclosed a first correction tape cassette 10 which is functionally compatible with the first typewriter ribbon cassette 2, and within which a first correction tape 12 of, for example, the lift-off type, together with other components, is housed. Such a cassette is described in copending U.S. patent application Ser. No. 161,870 filed Feb. 29, 1988 by Hans W. Mueller, entitled "Tape Cassette for Metering Correction Tape Feed". The ribbon cassette 2 and the functionally compatible correction cassette 10 may be designated a cassette combination or assembly. In operation, to delete an unwanted typed character from a document D, the lift-off tape 12 is raised to the print point p (best seen in FIG. 3) over the character, and the unwanted character on the type element 11 of a typewriter 13 (best seen in FIG. 3) is positioned to strike the lift-off tape 12. Typewriter actuating means, such as a typewriter key 15 (best seen in FIG. 3) causes the type element 11 to strike the lift-off tape 12 against the unwanted character on the document D, and the lift-off tape 12 withdraws the unwanted character from the document D.

The components in the first correction tape cassette 10 may include a supply roll 17 of correcting tape 12, means 19 for assuring the uniform withdrawal of correcting tape 12 from the supply roll 17 and a take-up spool 21. The first correction tape cassette 10 also includes a flat portion 14 having a formation 16 illustrated as an opening, in the right-hand portion, through which the tab formation 8 of the first typewriter ribbon cassette 2 extends when the cassettes 2,10 are inserted into the typewriter. As used herein, a functionally compatible cassette is one in which the ink ribbon in the first cassette is functionally compatible with the correction tape in the second cassette.

FIG. 1 further discloses a shiftable bracket section 18 of a typewriter or printer, the section 18 being adapted to operationally accommodate the first typewriter ribbon cassette 2 and the first correction tape cassette 10 thereon. The shiftable bracket section 18 is pivotable about pivot points 20 by conventional typewriter means 23 and 25 for presenting either the first typewriter ribbon 6 or the lift-off first correction tape 12 to the typewriter print point P (best seen in FIG. 3). The engagement of the tab formation 8 of the ribbon cassette 2 with the opening formation 16 of the first correction tape cassette 10 ensures that the cassettes 2,10 are compatible with each other. The cassettes 2 and 10 are configured so that unless the formations 8 and 16 are in operational engagement, the cassette assembly will not be capable of being inserted in the typewriter 13. Consequently, the typewrite 13 will be inoperable.

Figure 2:
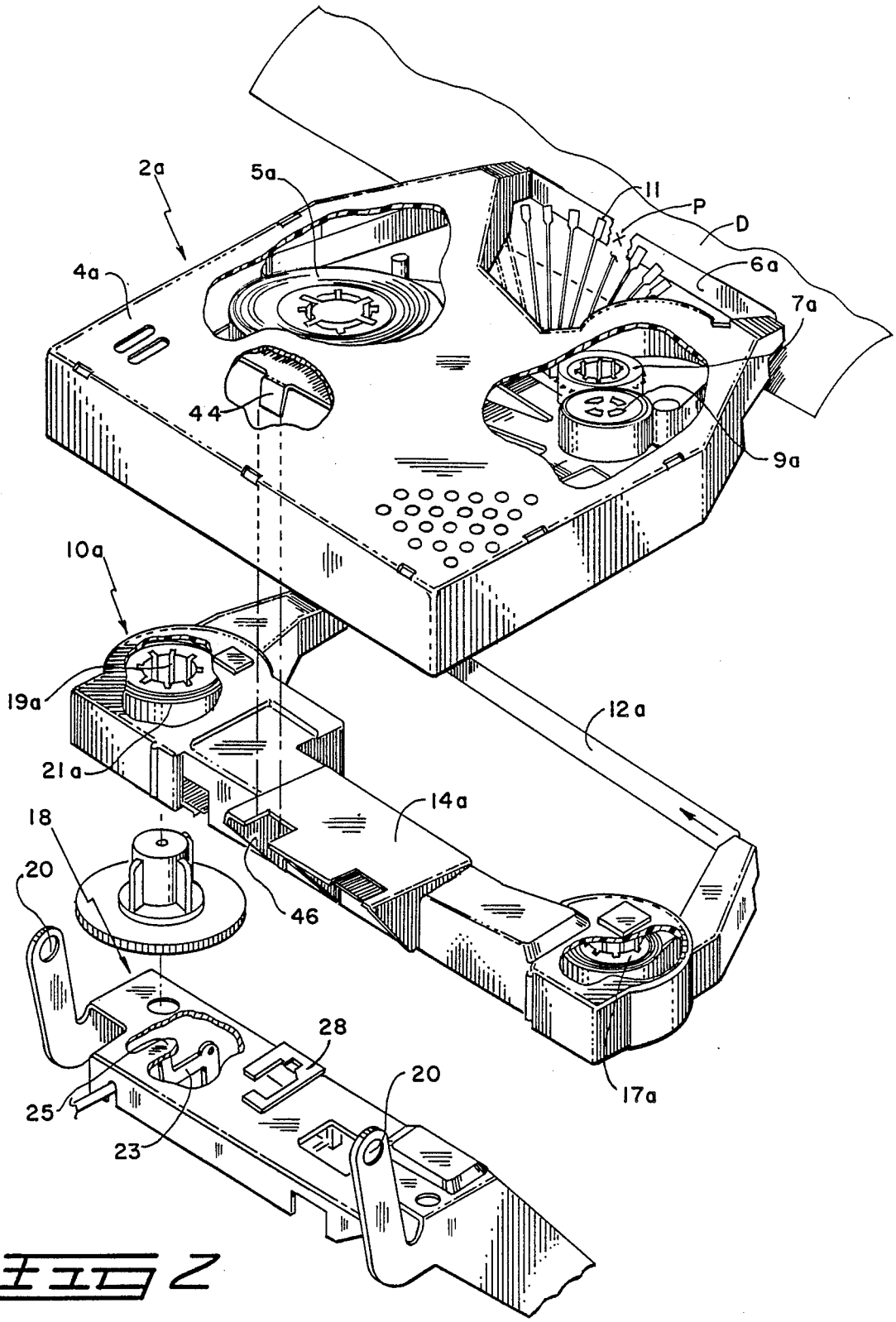
FIG. 2 is an exploded top perspective view of the present invention showing a cassette combination including a second typewriter ribbon cassette, a second correction tape cassette, and a partial view of a shiftable bracket section which carries the ribbon cassette and correction tape thereon.

FIG. 2 shows a second typewriter ribbon cassette 2*a* and a second correction tape cassette 10*a* which are generally similar in construction to the first typewriter ribbon cassette 2 and the first correction tape cassette 10 shown in FIG. 1. Therefore, in large part, the same numerical reference numerals will be used in FIG. 2 as were used in FIG. 1, except that the letter "a" will be added to the reference numerals of FIG. 2.

There is shown in FIG. 2 the second typewriter ribbon cassette 2*a* having a housing 4*a* within which a second typewriter ribbon 6*a*, which may be of the multiple-strike carbon ribbon type, and various other components are housed. A formation 44 such as a tab extends from the left-hand portion of the bottom of the housing 4*a* for the purpose to be hereinafter described. As noted above, a multiple-strike carbon ribbon is of the type which is incrementally fed in such a manner that upon a character being typed on a ribbon portion, the ribbon is advanced so that the next character is typed on a ribbon portion comprising both a typed ribbon portion and a fresh ribbon portion. These components may include, among other things, a supply roll 5*a* upon which a typewriter ribbon supply is located, mechanism 7*a* for assuring the uniform withdrawal of ribbon 6*a* from the supply roll 5*a* to the typewriter print point P (best seen in FIG. 3), and a take-up spool 9*a* on which the typed ribbon is located. Such a cassette is presently being sold by Smith Corona Corporation under its "H Multi-Strike" mark.

There is further shown in FIG. 2 the second correction tape cassette 10*a* which is functionally compatible with the second typewriter ribbon cassette 2*a*, and within which a second correction tape 12*a* of, for example, the cover-up type, together with other components, is housed. The ribbon cassette 2*a* and the functionally compatible correction cassette 10*a* may be designated a cassette combination or assembly. In operation, to delete an unwanted typed character from a document D, the cover-up tape 12*a* is raised to the print point P over the character, and the unwanted character on the type element 11 is positioned to strike the cover-up tape 12*a*. Typewriter actuating means 15 causes the type element 11 to strike the cover-up tape 12*a* against the unwanted character on the document D, and the cover-up tape 12*a* is transferred to and covers up the unwanted character.

The components in the second correction tape cassette 10*a* may include a supply roll 17*a* of correction tape 12*a*, means 19*a* for assuring the uniform withdrawal of correction tape 12*a* from the supply roll 17*a*, and a take-up spool 21*a*. The second correction tape cassette 10*a* also includes a portion 14*a* having a formation 46 illustrated as an opening in the left-hand portion, through which the tab 44 of the second typewriter ribbon cassette 2*a* extends when the cassettes 2*a*, 10*a* are inserted into the typewriter 13. The shiftable bracket section 18 shown in FIG. 2 is the same bracket section 18 shown in FIG. 1. The engagement of the tab formation 44 of the ribbon cassette 2*a* with the opening formation 46 of the second correction tape cassette 10*a* ensures that the cassettes 2*a*,10*a* are compatible with each other. The cassettes 2*a* and 10*a* are configured so that unless the formations 44 and 46 are in operational engagement, the cassettes 2*a*,10*a* will not be capable of being inserted in the bracket section 18. Consequently, the typewriter 13 will be inoperable.

In operation, downward movement of the tab formation 8, will only occur when the right-hand tab formation 8 can extend through the right-hand opening formation 16 in the flat portion 14 in compatible first correction tape cassette 10. If, however, instead of the first correction tape cassette 10 being present in the typewriter 13, an incompatible correction tape cassette, such as second correction tape cassette 10*a*, is present, which has no opening or only a left-hand opening formation 46 in the flat portion 14*a*, the tab formation 8 cannot extend downwardly through the opening, preventing seating of the first cassette 2 on the second correction tape cassette 10*a* and immediately indicating to the operator, by the interference of tab 8 holding the first cassette 2 above and not squarely against correction tape cassette 10*a*, that an attempt has been made to place an incompatible cassette into the typewriter 13. Conversely, the combination of the right-hand tab 8 and the right-hand opening 16 or the combination of the left-hand tab 44 and the left-hand opening 46 will assure that the first and second cassettes which are inserted in the device are functionally compatible with each other.

Similarly, with respect to the second typewriter ribbon cassette 2*a*, proper insertion of the cassette 2*a* will only occur when the left-hand tab formation 44 can extend through the left-hand opening formation 46 in the flat portion 14*a* in compatible second correction tape cassette 10*a*. If, however, instead of second correction tape cassette 10*a* being present in the typewriter 13, an incompatible first correction tape cassette is present, such as in this case cassette 10, which has only the right-hand opening 16 in the flat portion 14, the tab formation 44 cannot extend downwardly through the opening formation 46, preventing the seating of the second ribbon cassette 2*a* upon the first correction tape cassette 10. Thus, it will be seen that with respect to the embodiment shown in FIGS. 1 and 2, the typewriter 13 will not be operable when either the first typewriter ribbon cassette 2 and the second correction tape cassette 10*a*, or the second typewriter ribbon cassette 2*a* and the first correction tape cassette 10 are present therein.

It is to be understood that the present disclosure of a means for assuring cassette compatibility has been made only by way of example, and that changes in details of construction and the combination and arrangement of parts may be resorted to without departing from the true spirit and scope of the invention as hereinafter claimed.

What is claimed is:

1. A system utilizing a cassette assembly including selectively combined first and second cassettes, said system comprising in combination:

a device in which a first and second cassette of a selected structurally and functionally compatible assembly are inserted for operation of the device;

a first cassette for use in said device, said first cassette having an ink ribbon;

a second cassette for use in said device, said second cassette having a correction tape;

said ribbon in said first cassette and said correction tape in said second cassette of different assemblies being functionally incompatible with each other;

means on said first and second cassettes for assuring that the ink ribbon in said first cassette and the correction tape in said second cassette are functionally compatible with each other and for rendering the device operational only when said compatibility is assured; and said means being disposed in assembly-specific locations on said first and second cassettes, said location corresponding to the type of ribbon in said first cassette and the type of correction tape in said second cassette for preventing cassettes having incompatible ink ribbon and correction tape combinations from being properly placed in said device.

2. The system in accordance with claim 1 wherein said first cassette includes a housing, said means for assuring compatibility being located on said housing to depend therefrom.

3. The system in accordance with claim 2 wherein said means for assuring compatibility is a formation on said first cassette cooperating with means provided in connection with the second cassette which, upon said cassettes being inserted in the device, assure functionally compatibility of said ink ribbon in said first cassette with said correction tape in said second cassette.

4. The system in accordance with claim 1 wherein said first cassette of said cassette assembly has a single strike type carbon type ribbon and said second cassette has a lift-off type correcting tape.

5. The system in accordance with claim 4 wherein said means for assuring includes said first cassette having a depending tab formation, and said second cassette having an opening formation, said tab formation engaging said opening formation.

6. The system in accordance with claim 1 wherein said first cassette of said cassette assembly includes a multiple-strike type carbon ribbon and said second cassette has a cover-up type correction tape.

7. The system in accordance with claim 6 wherein said means for assuring includes said first cassette having a depending tab formation, and said second cassette having an opening formation, said tab formation engaging said opening formation.

8. In a system including a device and at least one assembly of selectively combined first and second cassettes, a method of inserting said cassette assembly into said device to effect the operation thereof, comprising:

providing said first cassette with depending compatibility means and an ink ribbon, the location of said compatibility means on said first cassette corresponding to the type of said ribbon;

providing said second cassette with a correction tape and accommodating means, the location of said accommodating means corresponding to the type of said correction tape, said correction tape being compatible with said ink ribbon of said first cassette of said assembly, the location of said accommodating means on said second cassette accommodating only said depending compatibility means of said first cassette of said selected cassette assembly and distinguishing said cassette assemblies from each other;

inserting said second cassette into said device; and inserting said first cassette into said device so that said depending compatibility means engages said accommodating means of said second cassette to assure that the ink ribbon of said first cassette is functionally compatible with the correction tape of the second cassette.

9. The method in accordance with claim 8 further comprising providing said first cassette with a single strike type carbon type ribbon and said second cassette with a lift-off type correction tape.

10. The method in accordance with claim 8 further comprising providing said first cassette with a multiple-strike type carbon ribbon and said second cassette with a cover-up type correction tape.

11. A cassette system comprising:

a first cassette including an ink ribbon therein, said first cassette having a tab thereon which may be located on one of at least two portions of said first cassette, said location being dependent upon the particular type of ink ribbon in the first cassette;

a second cassette including a correction tape therein, said second cassette having an opening therein which may be located in either one of two portions of said second cassette, said location being dependent upon the particular type of correction tape in the second cassette; and wherein the location of the first cassette tab and the location of the second cassette opening are in alignment to permit the first cassette tab to extend through the second cassette opening only when the particular type of ink ribbon in said first cassette is functionally compatible with the particular type of correction tape in the second cassette.

12. A ribbon cassette for use in conjunction with a correction cassette having a correction tape, comprising:

a housing having a bottom surface;

an ink ribbon substantially disposed in said housing; and compatibility means on said bottom surface of said housing for assuring compatibility between said ribbon and the correction tape, the location of said means on said housing corresponding to the type of said ribbon in said housing.

13. The ribbon cassette as defined in claim 12 wherein said means for assuring is a tab.

14. The ribbon cassette as defined in claim 13 wherein said tab is located on the right side of said bottom surface to indicate the presence of a single-strike carbon ribbon in said housing.

15. The ribbon cassette as defined in claim 13 wherein said tab is located on the left side of said bottom surface to indicate the presence of a multi-strike carbon ribbon in said housing.

16. A correction cassette for use in conjunction with a ribbon cassette having an ink ribbon, comprising:

a housing having an upper surface;

a correction tape substantially disposed within said housing;

means on said upper surface of said housing for assuring compatibility between said correction tape and the ribbon, the location of said means on said housing corresponding to the type of said correction tape in said housing.

17. The correction cassette as defined in claim 16 wherein said assuring means is an opening.

18. The correction cassette as defined in claim 17 wherein said opening is located on the right side of said upper surface to indicate the presence of a lift-off type of correction tape within said housing.

19. The correction cassette as defined in claim 17 wherein said opening is located on the left side of said upper surface to indicate the presence of a cover-up type of correction tape within said housing.

* * * * *